US009209537B2

(12) United States Patent
Hsu

(10) Patent No.: US 9,209,537 B2
(45) Date of Patent: Dec. 8, 2015

(54) ELECTRICAL CONNECTOR ASSEMBLY BETWEEN A FLEXIBLE PRINTED CIRCUIT BOARD AND A CENTRAL PROCESSING UNIT

(71) Applicant: HON HAI PRECISION INDUSTRY CO., LTD., New Taipei (TW)

(72) Inventor: Shuo-Hsiu Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 98 days.

(21) Appl. No.: 14/089,687

(22) Filed: Nov. 25, 2013

(65) Prior Publication Data

US 2014/0148021 A1 May 29, 2014

(30) Foreign Application Priority Data

Nov. 23, 2012 (TW) ..... 101144056 A

(51) Int. Cl.
*H01R 12/00* (2006.01)
*H01R 12/70* (2011.01)
*H01R 12/79* (2011.01)

(52) U.S. Cl.
CPC ..... *H01R 12/7029* (2013.01); *H01R 12/79* (2013.01)

(58) Field of Classification Search
CPC ..... H01R 12/51; H01R 12/52; H01R 12/523; H01R 12/77; H01R 12/79; H01R 12/712; H01R 12/716; H01R 12/777
USPC ..... 439/67, 77, 492, 493, 499
See application file for complete search history.

(56) References Cited

U.S. PATENT DOCUMENTS

| | | | | |
|---|---|---|---|---|
| 6,634,890 | B2 * | 10/2003 | Peterson et al. | 439/67 |
| 8,267,700 | B2 * | 9/2012 | Mizoguchi | 439/67 |
| 8,585,433 | B2 * | 11/2013 | Honda | 439/499 |
| 2006/0292900 | A1 * | 12/2006 | Pabst et al. | 439/67 |
| 2007/0149000 | A1 * | 6/2007 | Baskaran et al. | 439/67 |

FOREIGN PATENT DOCUMENTS

| | | |
|---|---|---|
| TW | M429188 | 5/2012 |

* cited by examiner

*Primary Examiner* — Vanessa Girardi
(74) *Attorney, Agent, or Firm* — Wei Te Chung; Ming Chieh Chang

(57) ABSTRACT

An electrical connector assembly for connecting a CPU with an FPC includes a first electrical connector having a first insulating housing and a plurality of first contacts retained in the first insulating housing, a second electrical connector electrically connecting the first electrical connector in a vertical direction having a second insulating housing and a plurality of second contacts retained in the second insulating housing, and a protecting cover assembled between the first electrical connector and the second electrical connector. The protecting cover includes a base and a plurality of through holes running through the base for receiving the second contacts to contact with the first contacts. The protecting cover includes a pair of buckling portions for locking the FPC and an acting portion extending upwardly from the buckling portion, the acting portion release the buckling portion off the FPC when a hand push the acting portion.

20 Claims, 9 Drawing Sheets

ELECTRICAL CONNECTOR ASSEMBLY BETWEEN A FLEXIBLE PRINTED CIRCUIT BOARD AND A CENTRAL PROCESSING UNIT

BACKGROUND OF THE INVENTION

1. Field of the Invention

The present disclosure relates to an electrical connector assembly, and more particularly to an electrical connector assembly connecting a central processing unit (CPU) with a flexible printed circuit (FPC).

2. Description of Related Art

TW patent number M429188 issued to HSU on May 11, 2012 discloses an electrical connector assembly. The electrical connector assembly comprises a first electrical connector soldered on a CPU and a second electrical connector soldered on an FPC. The first electrical connector comprises a first insulating housing and a plurality of first contacts received in the first insulating housing. The second electrical connector comprises a second insulating housing and a plurality of second contacts received in the second insulating housing. The first contacts are pin contacts while the second contacts comprise contacting arms for inserted by the pin contacts so as to establish electrical connection between the CPU and the FPC.

However, when used, the first electrical connector has to be inserted into the second electrical connector or pulled off from the second electrical connector by hand. Thus the first contact and the second contact are easy to be damaged if the insert force or pull force are too large. Therefore the electrical connection therebetween is unreliable.

In view of the above, an improved electrical connector assembly is desired to overcome the problems mentioned above.

SUMMARY OF THE INVENTION

Accordingly, an object of the present disclosure is to provide an electrical connector assembly with a protecting cover for protecting pin contacts and removing the electrical connectors easily.

According to one aspect of the present disclosure, an electrical connector assembly for electrically connecting a central processing unit (CPU) to a flexible printed circuit board (FPC), includes a first electrical connector having a first insulating housing and a plurality of first contacts retained in the first insulating housing, a second electrical connector electrically connecting the first electrical connector in a vertical direction having a second insulating housing and a plurality of second contacts retained in the second insulating housing, and a protecting cover assembled between the first electrical connector and the second electrical connector. The protecting cover includes a base and a plurality of through holes running through the base for receiving the second contacts to contact with the first contacts. The protecting cover includes a pair of buckling portions for locking the FPC and an acting portion extending upwardly from the buckling portion, the acting portion release the buckling portion off the FPC when a hand push the acting portion.

Other objects, advantages and novel features of the disclosure will become more apparent from the following detailed description when taken in conjunction with the accompanying drawings, in which:

DETAILED DESCRIPTION OF THE INVENTION

Figure 1:
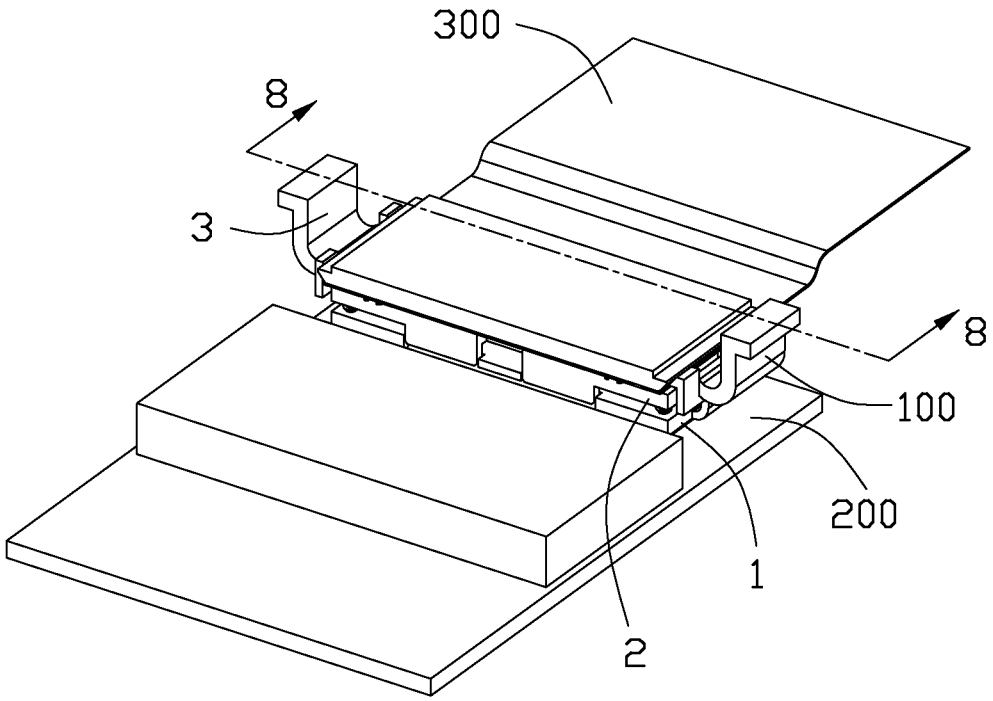
FIG. 1 is an assembled, perspective view of an electrical connector assembly with a CPU and an FPC in accordance with a preferred embodiment of the present disclosure.
Figure 2:
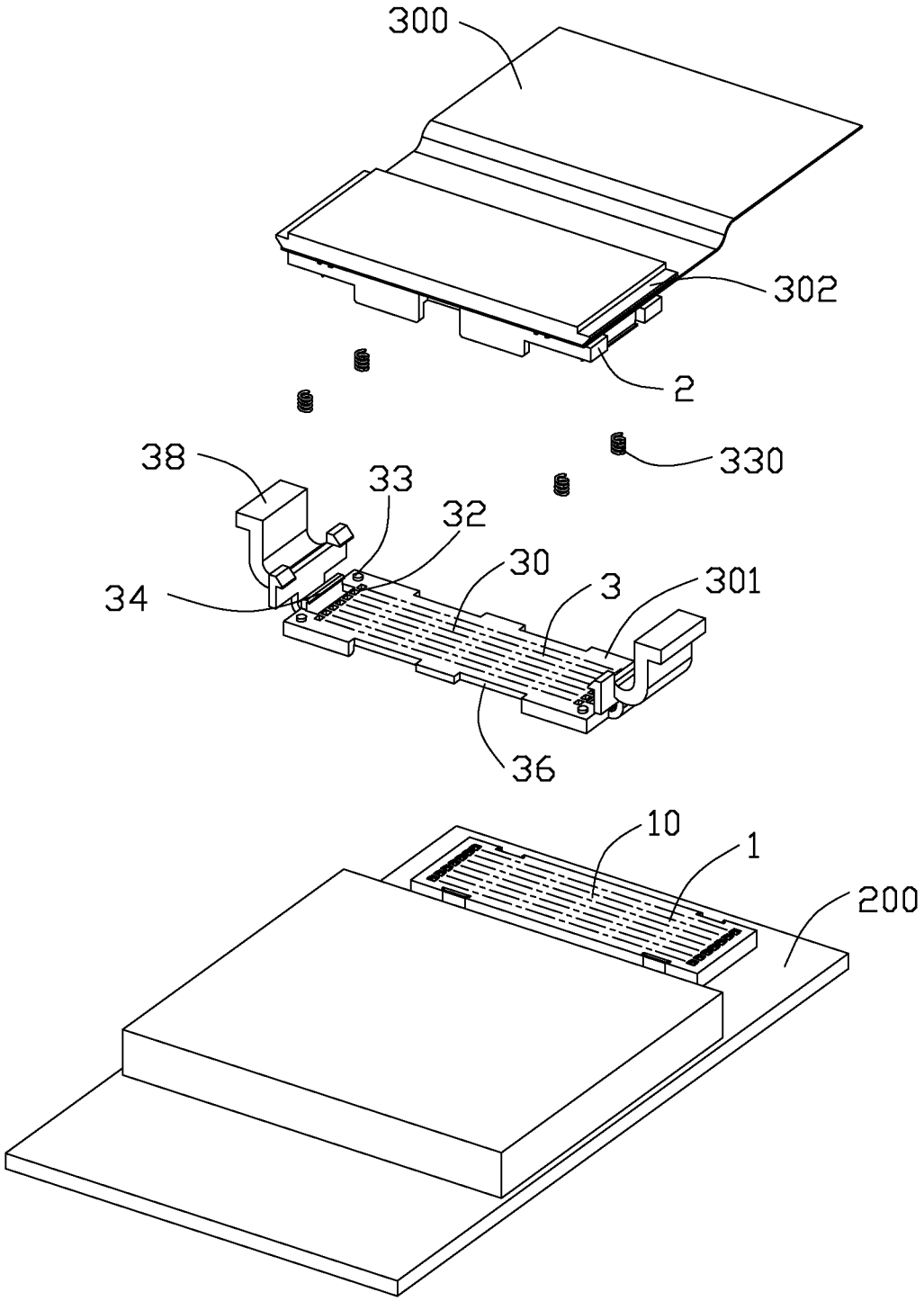
FIG. 2 is an exploded, perspective view of the electrical connector assembly shown in FIG. 1, wherein a first electrical connector connecting the CPU, a second electrical connector connecting the FPC.
Figure 3:
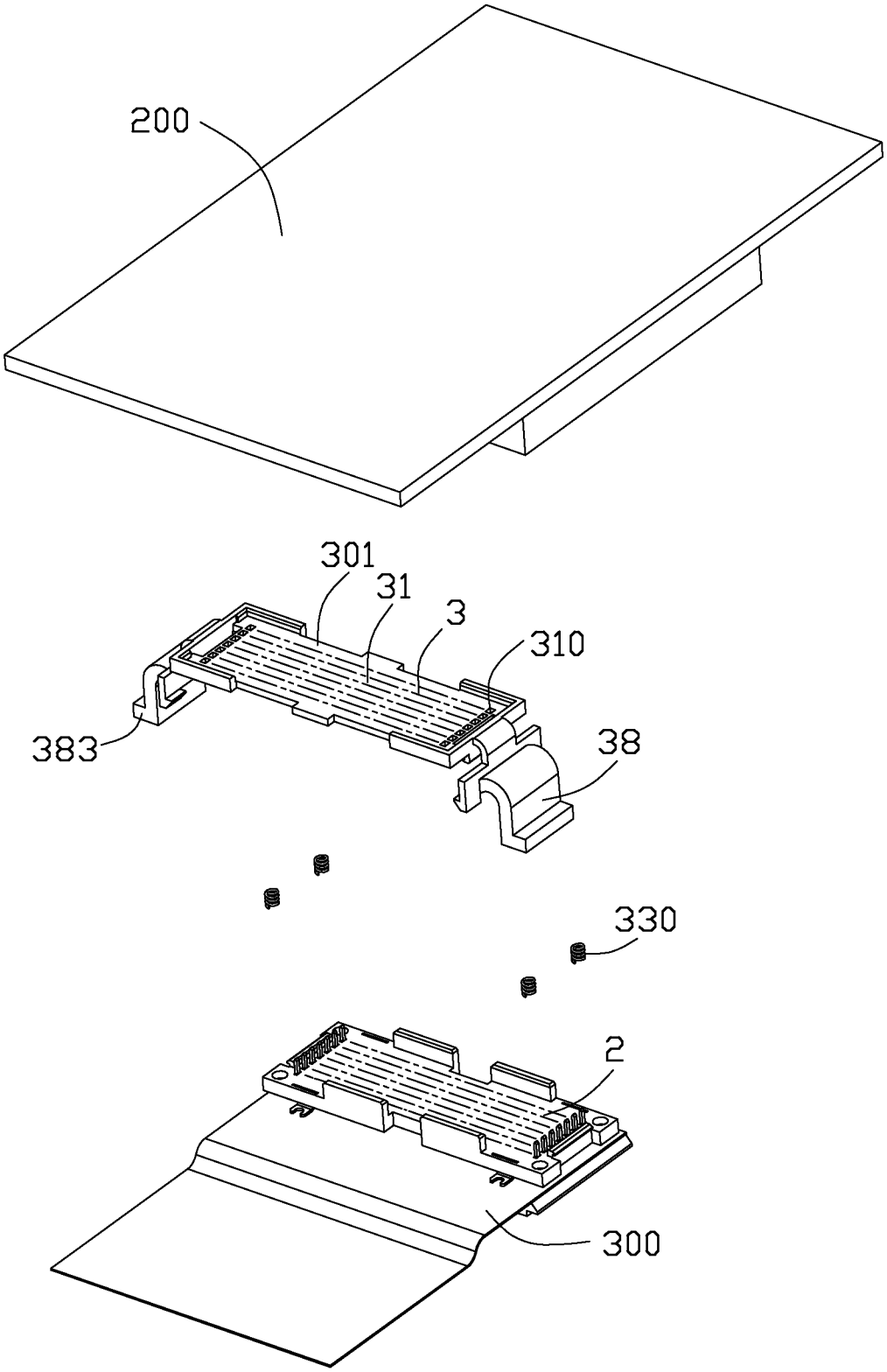
FIG. 3 is another view of the electrical connector assembly shown in FIG. 2.
Figure 4:
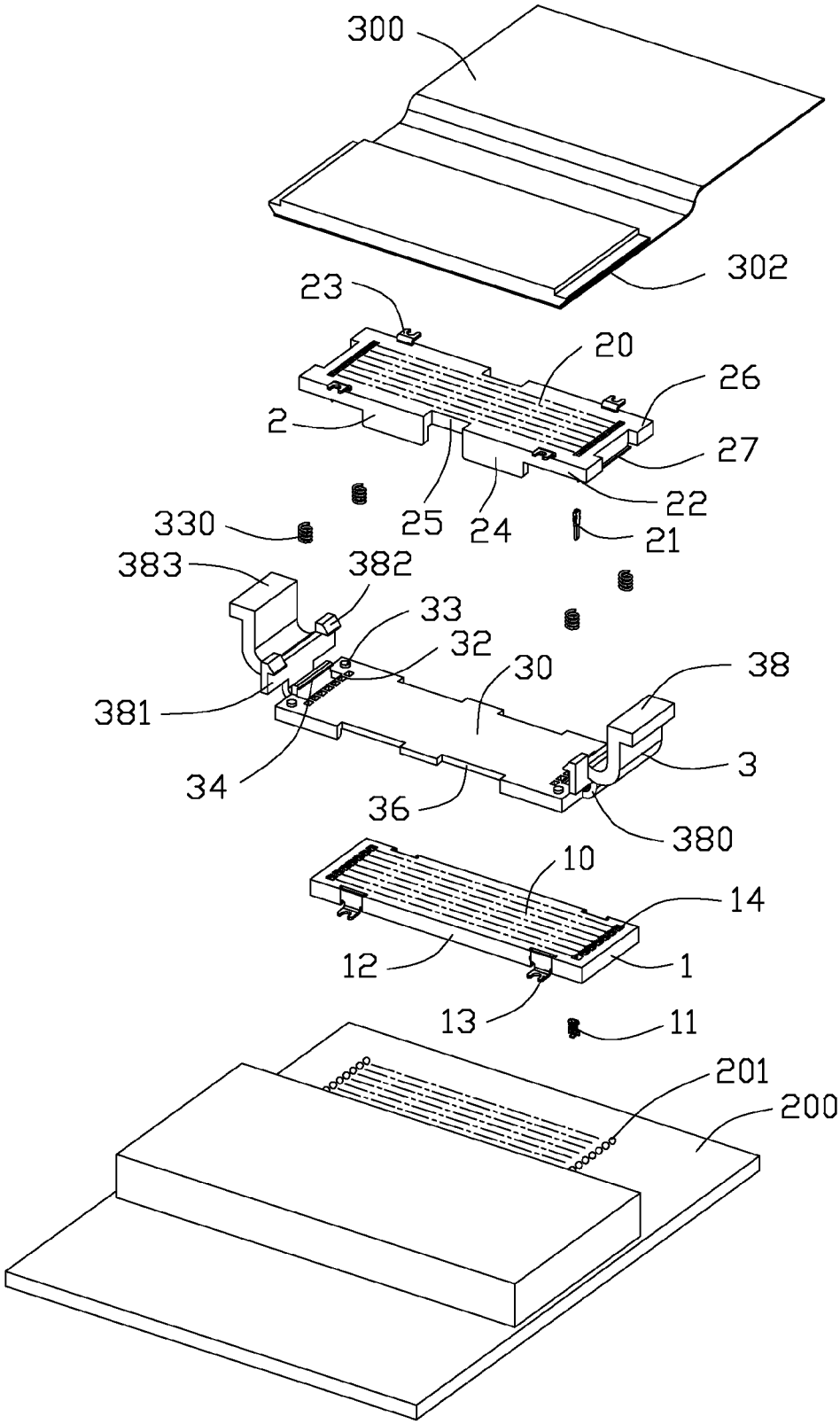
FIG. 4 is a view similar to the FIG. 2, wherein the electrical connector assembly, the CPU and the FPC are separated from each other.
Figure 5:
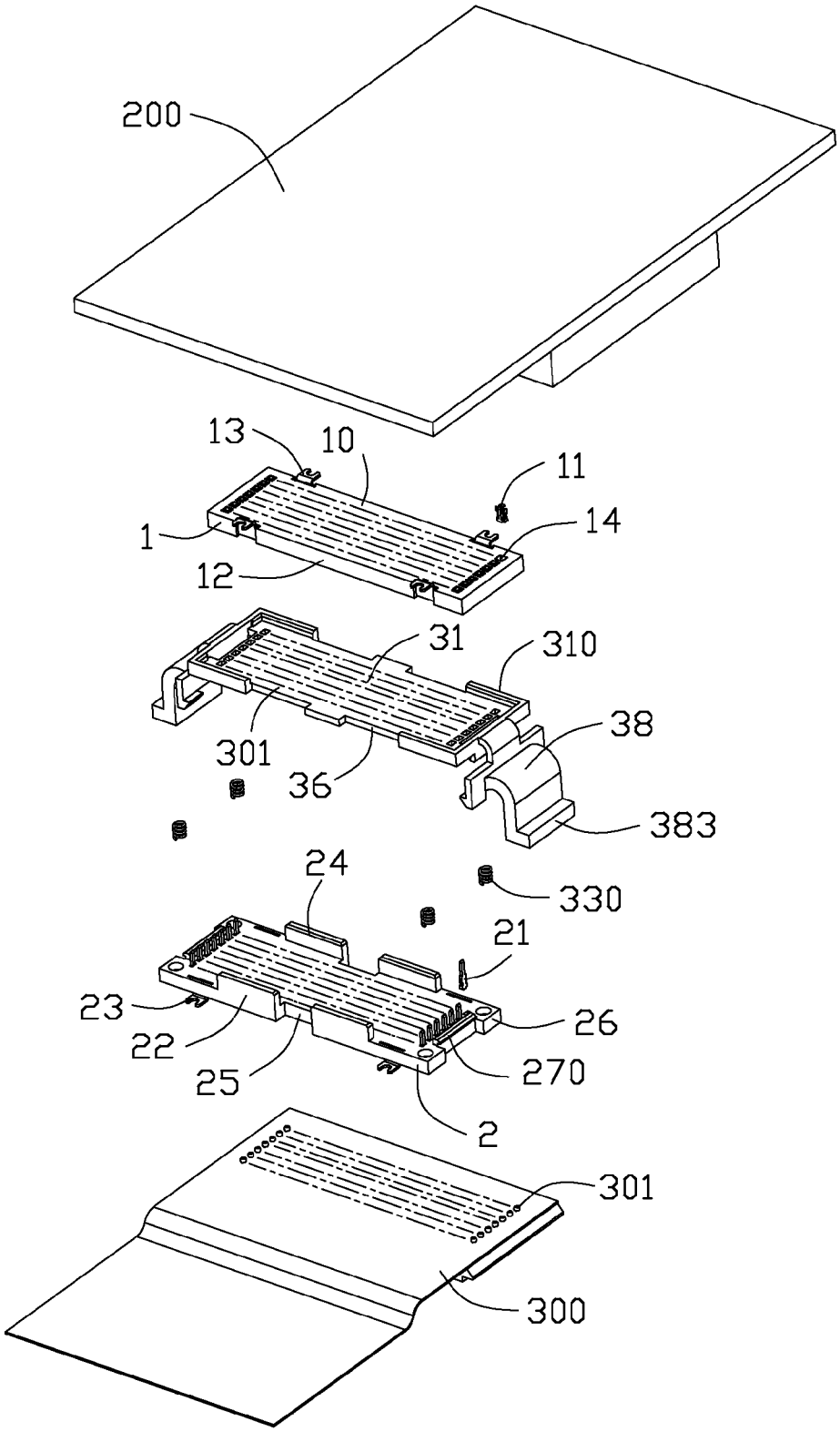
FIG. 5 is another view of the electrical connector assembly shown in FIG. 4.
Figure 6:
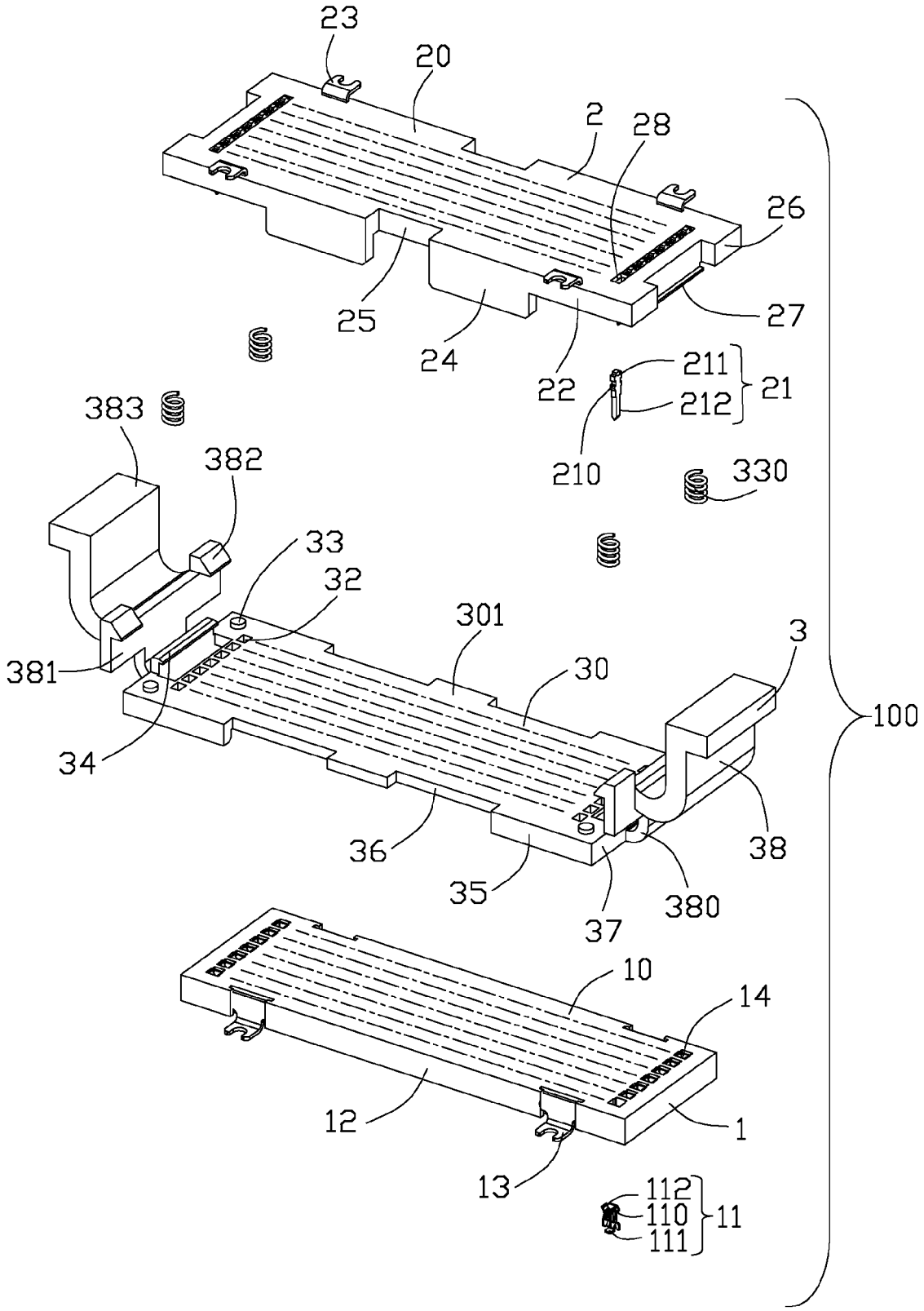
FIG. 6 is an exploded, perspective view of the electrical connector assembly shown in FIG. 4.

Reference will now be made to the drawings to describe the preferred embodiment of the present disclosure in detail.

Referring to FIG. 1 to FIG. 9, an electrical connector assembly 100 for electrically connecting a CPU 200 to an FPC 300, comprises a first electrical connector 1 assembled on the CPU 200, a second electrical connector 2 assembled on the FPC 300, and a protecting cover 3 assembled between the first electrical connector 1 and the second electrical connector 2.

Referring to FIGS. 4 to 7, the first electrical connector 1 is soldered on the CPU 200. The first electrical connector 1 comprises a first insulating housing 10 with a plurality of first contact holes 14, a plurality of first contacts 11 received in the first contact holes 14, and a plurality of metal ears 13 assembled on the first insulating housing 10.

The first contact 11 is completely accommodated in the first contact hole 14 of the first insulating housing 10. The first contact 11 comprises a body portion 110, a soldering portion 111 extending downwardly from the body portion 110 for soldering on the CPU 200 through a solder ball, and a pair of contacting arms 112 extending from two opposite sides of the body portion 110.

The second electrical connector 2 is soldered on the FPC 300. The second electrical connector 2 comprises a second insulating housing 20 with a plurality of second contact holes 28, a plurality of second contacts 21 received in the second contact holes 28, and a plurality of metal ears 23 retained in the second electrical connector 2. The second insulating housing 20 comprises a pair of lengthwise sides 22. The second insulating housing 20 comprises two pairs of guiding portions 24 extending downwardly from the lengthwise sides 22 and a pair of recesses 25 between the guiding portions 24. The second insulating housing 20 further defines a pair of recesses and each formed an end thereof and a protruding portion 27 protruded in the recesses. The metal ear 13 of the first insulating housing 10 is the same structure with the metal ear 23 of the second electrical connector 2.

Figure 7:
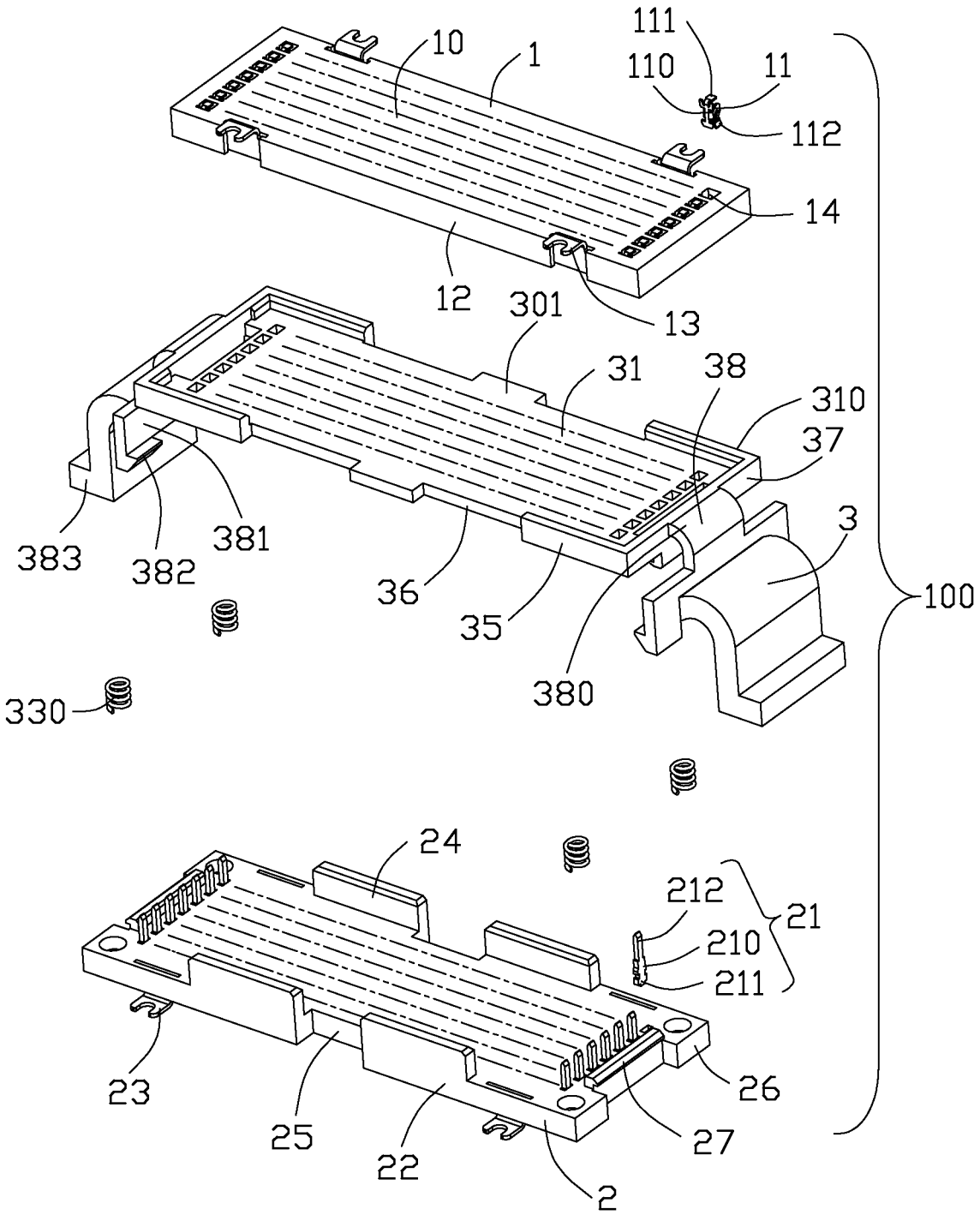
FIG. 7 is another view of the electrical connector assembly shown in FIG. 6.

Referring to FIG. 7, the second contact 21 comprises a retention portion 210 retaining on the second electrical connector 2, an upper contacting portion 211 extending upwardly from the retention portion 210, and a lower contacting portion 212 extending downwardly from the retention portion 210. The second contact 21 is soldered on the FPC 300 though a solder ball.

Referring to FIG. 6 to FIG. 9, the protecting cover 3 is assembled on the second electrical connector 2. The protecting cover 3 comprises a base 301. The base 301 defines a top surface 30 for supporting the second electrical connector 2 and a bottom surface 31 opposite to the top surface 30 for matching the first electrical connector 1. The base 301 has a plurality of holes 32 corresponding to the second contacts 21. The base 301 comprises four posts 33 defined four corners thereof, a pair of locking portions 34 formed two ends of the base 301 and defined between the two posts 33, a slot 36 extending inwardly from two lengthwise sides of the base 301 and an operating portion 38 extending upwardly from two width sides 37. The operating portion 38 has a bending portion 380 bent and extending upwardly from one end of the base 301, a connecting portion or arm 381 protruded from the bending portion 380, a buckling portion 382 formed on an upper end of the connecting portion 381, an acting portion 383 bent and extending upwardly from a middle side of the connecting portion 381. The buckling portion 382 is located above the bending portion 380 and outside of the locking portions 34. Wherein, a spring 330 is assembled on the posts 33 for resiliently urging the second electrical connector 2. A plurality of side walls 310 are formed on the bottom surface 31 of the base 301 of the protecting cover 3 and define a cavity for receiving the first electrical connector 1. A pair of stepping portions 302 is formed by extending inwardly from two sides of the upper surface of the FPC 300 respectively. When the buckling portion 382 of the operating portion 38 is locked on the stepping portion 302 of the FPC 300, the second contacts 21 of the second electrical connector 2 contact with the first contact 11 of the first electrical connector 1.

Figure 8:
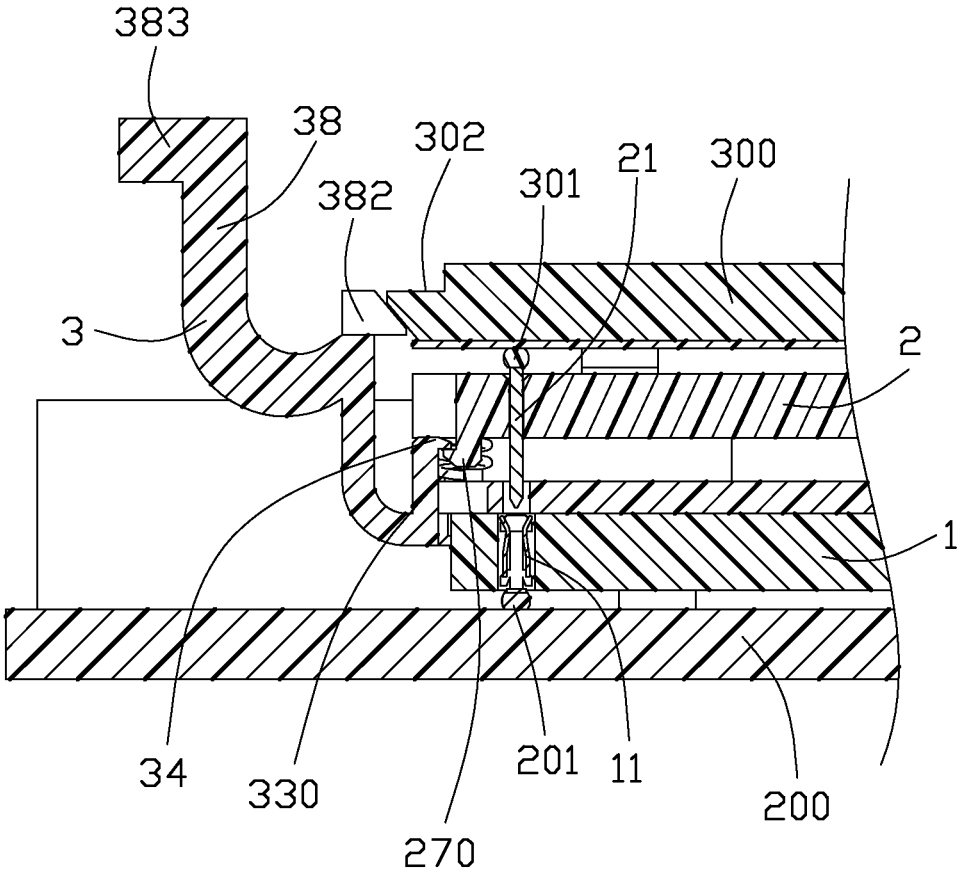
FIG. 8 is a sectional view of the electrical connector shown in FIG. 1 along line 8-8.
Figure 9:
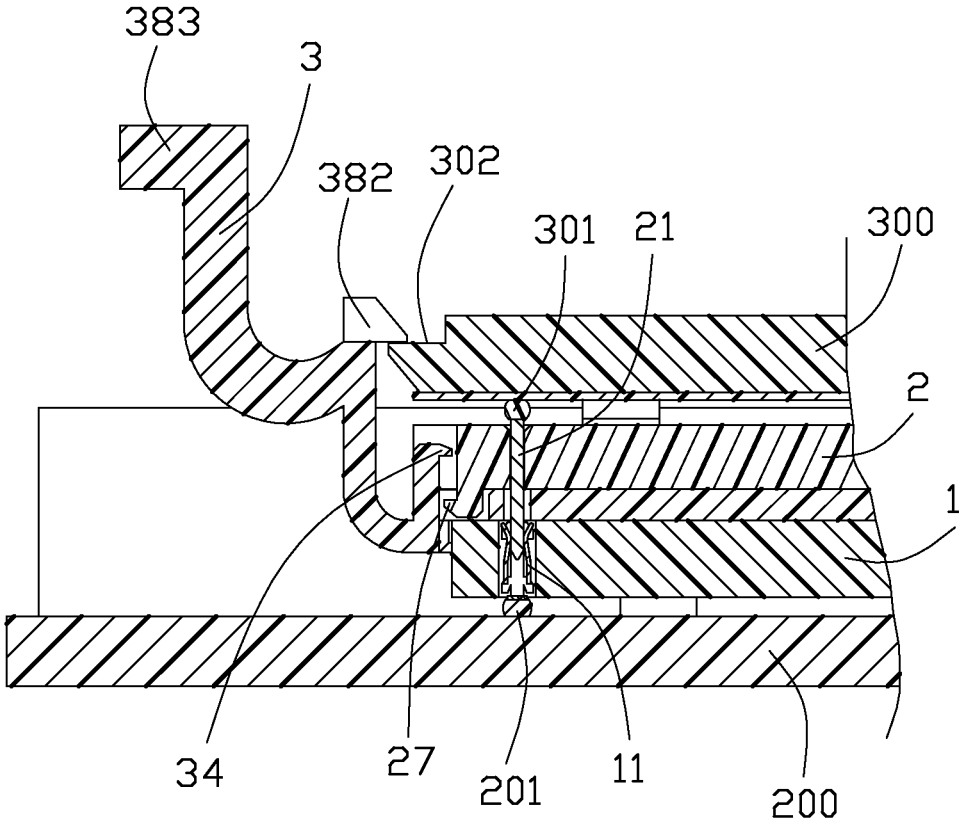
FIG. 9 is a view similar to the FIG. 8, wherein the protecting cover locked on the FPC.

When assembling, the second contact 21 is assembled into the second electrical connector 2 and soldered with the FPC 300, the first contact 11 is assembled into the first electrical connector 1 and soldered with the CPU 200. The first electrical connector 1 together with the CPU 200 is assembled into the cavity of the protecting cover 3 formed by the side walls 310 for aligning the protecting cover 3 with the first electrical connector 1. The bottom surface 31 of the protecting cover 3 contacts the first electrical connector 1, the top surface 30 of the base 301 is assembled towards the second electrical connector 2. Two guiding portions 24 of the second electrical connector 2 are assembled into the slots 36 of the protecting cover 3. The lower contacting portion 212 of the second contact 21 extends into the hole 32 of the base 301 of the protecting cover 3. Referring to FIG. 8, the spring 330 is installed on the post 33 in a stressed state, locking portions 34 of the protecting cover 3 engages with the protruding portion 27 of the second electrical connector 2, the operating portion 38 of the protecting cover 3 does not lock on the stepping portions 302 of the FPC 300, the first contact 11 of the first electrical connector 1 does not contact the second contact 21 of the second electrical connector 2. Referring to FIG. 9, when operating the acting portion 383 of the operating portion 38, the acting portion 383 moves downwardly and outwardly, the FPC 300 together with the second electrical connector 2 to moves downwardly, the spring 330 is further pressed to the posts 33. The lower contacting portion 212 of the second electrical connector 2 moves downwardly and contacts the contacting arms 112 of the first contact 11. And then releases the acting portion 383, the buckling portion 382 locks on the stepping portion 302 so as to establish an electrical connection therebetween. When removing, operating the acting portion 383 of the operating portion 38 of the protecting cover 3 far away from the stepping portions 302 of the FPC 300, the spring 330 releases to urge the second electrical connector 2 to move upwardly, the second contact 21 moves upwardly and separates from first contact 11. Thus the second electrical connector 2 can be removed from the first electrical connector 1 easily.

According to the above described embodiment of the present disclosure, an electrical connector assembly having a protecting cover 3 is provided. The protecting cover 3 comprises a buckling portion 382 for engaging with the FPC 300 and a spring 330 located between the second connector 2 and the protecting cover 3, and wherein when the buckling portion 382 engages the FPC, the first contact 11 contacts the second contact, while when the buckling portion 382 disengages the FPC 300, the spring 330 resiliently urges the second electrical connector 2 upwardly and the first contact 11 separates from the second contact 21. Therefore, in this embodiment, the first feature is to provide the resiliently urging means for dedicate disengagement between the coupled contacts of the two mated connectors, and the second feature is to provide the protecting cover 3 to shield the pin type contacts 21 which are originally arranged in an exposed manner while being shield by the protecting cover 3. Understandably, in this embodiment for implementing both two features simultaneously the protecting cover is assembled to the second connector.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector assembly for connecting a Central Processing Unit (CPU) with a Flexible Printed Circuit Board (FPC) comprising:

a first electrical connector for assembling with a CPU, the first electrical connector comprising a first insulating housing and a plurality of first contacts received in the first insulating housing;

a second electrical connector for mounting on the FPC, the second electrical connector comprising a second insulating housing and a plurality of second contacts received in the second insulating housing, the second contacts having lower contacting portions extending downwardly and beyond the second insulating housing for respectively engaging with the first contacts; and a protecting cover assembled between the first and second electrical connectors, comprising a buckling portion which engages with the second electrical connector, and a spring located between the second electrical connector and the protecting cover, and wherein when the buckling portion engages the FPC, when the buckling portion disengages from the second electrical connector, the spring resiliently urges the second electrical connector to move upwardly and the first contacts separate from the second contacts.

2. The electrical connector assembly as claimed in claim 1, wherein the protecting cover comprises a locking portion below the buckling portion, the second electrical connector comprises a protruding portion corresponding to the locking portion, the locking portion of the protecting cover locks with the protruding portion of the second electrical connector.

3. The electrical connector assembly as claimed in claim 2, wherein the protecting cover comprises a bending portion, the buckling portion formed on an upper end of the bending portion and outside of the locking portion.

4. The electrical connector assembly as claimed in claim 2, wherein the protecting cover comprises a plurality of side walls extending downwardly from a bottom surface of the protecting cover for installing the first electrical connector.

5. The electrical connector assembly as claimed in claim 4, wherein the protecting cover comprises a base, the base defines four posts on four corners thereof, the spring is assembled on the post.

6. An electrical connector assembly for connecting a Central Processing Unit (CPU) with a Flexible Printed Circuit Board (FPC) comprising:

a first electrical connector for connecting the CPU and comprising a first insulating housing and a plurality of first contacts retained in the first insulating housing;

a second electrical connector for mounting to the FPC and electrically connecting the first electrical connector in a vertical direction, the second electrical connector comprising a second insulating housing and a plurality of second contacts retained in the second insulating housing; and a protecting cover assembled between the first electrical connector and the second electrical connector, the protecting cover comprising a base and a plurality of through holes running through the base for receiving the second contacts to mate with the first contacts, wherein the protecting cover has a pair of buckling portions for locking the second electrical connector, and acting portions extending upward from the buckling portion, wherein the acting portions release the buckling portion from the second connector when the acting portions are activated.

7. The electrical connector assembly as claimed in claim 6, wherein the protecting cover comprises a plurality of side walls extending from a bottom surface of the protecting cover for installing the first electrical connector.

8. The electrical connector assembly as claimed in claim 6, wherein the electrical connector assembly further comprises a spring sandwiched between the protecting cover and the second connector in the vertical direction for urging the second electrical connector to move upwardly.

9. The electrical connector assembly as claimed in claim 8, wherein the base defines four posts extending upwardly from the base, the spring is assembled on at least one of the post.

10. The electrical connector assembly as claimed in claim 6, wherein the protecting cover comprises a locking portion, the buckling portion is located above and outside of the locking portion.

11. The electrical connector assembly as claimed in claim 10, wherein the second electrical connector comprises a protruding portion corresponding to the locking portion, when the buckling portion disengages the FPC, the locking portion engages the protruding portion.

12. The electrical connector assembly as claimed in claim 10, wherein the protecting cover comprises a bending portion outside of the locking portion, the buckling portion extending upwardly from the bending portion.

13. An electrical connector assembly comprising:

a stationary first connector unit including an insulative first housing with a plurality of first contacts therein;

a moveable second connector unit including an insulative second housing with a plurality of second contacts therein for mating with the first connector unit in a vertical direction;

an insulative protecting cover defining a planar base located between the first housing and the second housing in said vertical direction, said planar base being equipped with a plurality of through holes in the vertical direction for receiving the corresponding first contacts therein;

said second connector unit occupying first and second positions with regard to the protecting cover in the vertical direction;

when the second connector unit occupies the first position with regard to the protecting cover, tips of the second contacts are protectively hidden within the planar base without mating with the corresponding first contacts;

when the second connector unit is moved in the vertical direction to the second position with regard to the protecting cover, the tips of the second contacts extend the planar base and mate with the corresponding first contacts.

14. The electrical connector assembly as claimed in claim 13, wherein said second contacts are of a pin type.

15. The electrical connector assembly as claimed in claim 13, wherein said first connector unit includes a CPU (Central Processing Unit), and the second connector unit includes a FPC (Flexible Printed Circuit) sub-assembly.

16. The electrical connector assembly as claimed in claim 13, wherein said protecting cover is assembled to the second connector unit while allowing said second connector unit to be relatively moveable thereto in the vertical direction.

17. The electrical connector assembly as claimed in claim 16, further including means for aligning the protecting cover with the first connector unit.

18. The electrical connector assembly as claimed in claim 16, further including a spring between the planar base and the second housing to constantly urge the second housing away from the second position to the first position.

19. The electrical connector assembly as claimed in claim 18, wherein said protecting cover includes a deflectable connecting arm with a buckling portion thereon, and further includes an operation portion to move the connecting arm and the associated buckling portion for unlocking the second connector unit so as to have the second connector unit moved from the second position to the first position due to resiliency of said spring.

20. The electrical connector assembly as claimed in claim 19, wherein said protecting cover further includes a substantially immovable locking portion as a stop to have the second connector unit stopped at the second position once the second connector unit is moved from the first position to the second position by overcoming forces derived from said resiliency of the spring.

* * * * *